US006564561B2

(12) United States Patent
Daum et al.

(10) Patent No.: US 6,564,561 B2
(45) Date of Patent: May 20, 2003

(54) METHODS AND APPARATUS FOR REFRIGERATOR TEMPERATURE DISPLAY

(75) Inventors: Wolfgang Daum, Louisville, KY (US); Steven Gray, Prospect, KY (US); John S. Holmes, Sellersburg, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/742,531

(22) Filed: Dec. 22, 2000

(65) Prior Publication Data

US 2002/0112488 A1 Aug. 22, 2002

(51) Int. Cl.[7] ..... G01K 13/00
(52) U.S. Cl. ..... 62/130; 62/127; 374/102
(58) Field of Search ..... 62/125, 126, 127, 62/129, 130, 131; 236/46 F; 374/102, 103, 115, 170; 702/130

(56) References Cited

U.S. PATENT DOCUMENTS 4,298,947 A * 11/1981 Tamura et al. ..... 702/130
4,387,578 A 6/1983 Paddock ..... 62/127
4,490,986 A 1/1985 Paddock ..... 62/127
4,504,010 A * 3/1985 Sukimoto et al. ..... 236/46 F
4,646,528 A 3/1987 Marcade et al. ..... 62/127
5,337,575 A 8/1994 Ishihara ..... 62/126
5,850,969 A * 12/1998 Hong et al. ..... 374/115 X

* cited by examiner

*Primary Examiner*—Harry B. Tanner
(74) *Attorney, Agent, or Firm*—H. Neil Houser, Esq.; Armstrong Teasdale LLP

(57) ABSTRACT

A system for displaying a temperature of a refrigerator compartment including at least one temperature sensor is provided that emulates the function and behavior of a thermostat to control and display refrigerator compartment temperature in a simple and intuitive manner. The system includes a controller including a processor and a memory and operatively coupled to the temperature sensor. A human machine interface board includes a display and is coupled to the controller and configured for receiving user input of a refrigerator compartment setting. The controller is configured to accept a set temperature of the at least one compartment, monitor actual temperature of the compartment; and display a damped temperature value based on operating conditions of the refrigerator.

21 Claims, 10 Drawing Sheets

METHODS AND APPARATUS FOR REFRIGERATOR TEMPERATURE DISPLAY

BACKGROUND OF THE INVENTION

This invention relates generally to refrigerators and, more particularly, to an apparatus and method for displaying a temperature of a refrigerator compartment.

Known refrigeration appliances typically include one or more refrigeration compartments for the storage of fresh food and for frozen food storage. Conventionally, temperature settings for fresh food compartments and freezer compartments are adjustable through manipulation of an electromechanical mechanism, such as a dial or sliding switch. Depending on a user selected position of the electromechanical mechanism or mechanisms, refrigerator controls regulate the temperature of the respective refrigerator compartments to a temperature corresponding to the temperature position. However, because with these systems there is no apparent way to determine an actual temperature of the departments, operating temperature settings are often determined by user trial and error. In addition, excessive deviation from selected temperature settings indicative of a refrigerator malfunction are difficult to detect.

The proliferation of electronic controls in appliances offer enhanced control schemes for appliances, including, for example, feedback displays to the user indicative of temperature settings. Thus, the displays provide visual confirmation of selected settings as well as confirmation that selected temperatures are being maintained. However, electronic controls can sometimes be confusing to operate, and further can mislead users to believe that the appliance is not operating properly because the system does not respond like conventional electromechanical systems. Thus, for example, indication of rapid temperature changes or apparently unstable temperature displays may cause a user to place a service call when the refrigerator is otherwise working normally. As another example, when a new temperature setting does not produce immediate change in refrigerator behavior, (as will be the case when the new temperature setting is below the actual temperature of the compartment) a user may believe that the refrigerator is not working.

It would be desirable to provide an easy to use electronic control system for a refrigerator that includes temperature displays while avoiding behavior inconsistent with conventional systems.

BRIEF SUMMARY OF THE INVENTION

In an exemplary embodiment of the invention, a system for displaying a temperature of a refrigerator compartment including at least one temperature sensor is provided that emulates the function and behavior of a thermostat to control and display refrigerator compartment temperature in a simple and intuitive manner. The system includes a controller including a processor and a memory, and is operatively coupled to the temperature sensor. A human machine interface board includes a display and is coupled to the controller and configured for receiving user input of a refrigerator compartment setting. The controller is configured to accept a set temperature of the compartment, monitor an actual temperature of the compartment; and display a damped temperature value based on operating conditions of the refrigerator.

In one embodiment, the controller damps the temperature value for one of several fixed time constants depending on a mode of operation of the refrigerator and conditions in the refrigerator compartment. Alternatively, the controller calculates a damped temperature value based upon a rolling average of actual temperature and the set temperature, or upon a rolling average of actual temperature and a current display register value in the controller memory. Therefore, displayed temperature values are adjusted in a stable manner.

Moreover, the controller is configured to respond appropriately to user settings where a response is not otherwise necessary to confirm to the user that the system is operating. Thus, for example, if a temperature setting is lowered to a point above the operating temperature of the compartment, fans are energized briefly in accordance with user expectations that the adjusted setting should cause the fans to be turned on. User confusion and possible associated service calls due to a non-responsive refrigerator is therefore avoided.

DETAILED DESCRIPTION OF THE INVENTION

Figure 1:
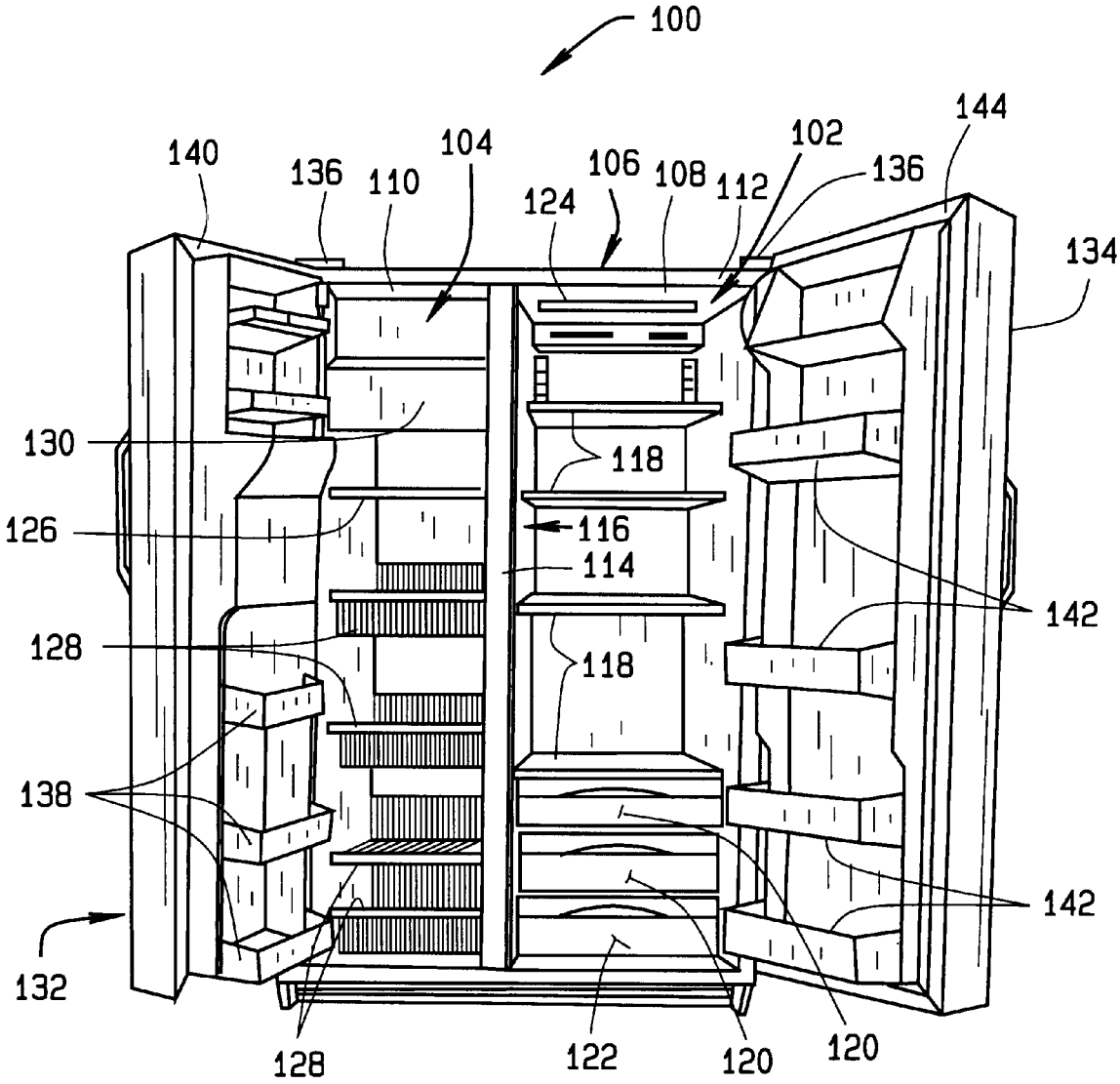
FIG. 1 is a perspective view of a refrigerator.

FIG. 1 illustrates a side-by-side refrigerator 100 in which the present invention may be practiced. It is recognized, however, that the benefits of the present invention apply to other types of refrigerators, freezers, and refrigeration appliances wherein frost free operation is desirable. Consequently, the description set forth herein is for illustrative purposes only and is not intended to limit the invention in any aspect.

Refrigerator 100 includes a fresh food storage compartment 102 and a freezer storage compartment 104. Freezer compartment 104 and fresh food compartment 102 are arranged side-by-side. A side-by-side refrigerator such as refrigerator 100 is commercially available from General Electric Company, Appliance Park, Louisville, Ky. 40225.

Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. It will be understood that in a refrigerator with separate mullion dividing a unitary liner into a freezer and a fresh food compartment, a front face member of mullion corresponds to mullion 114. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 partly forms a quick chill and thaw system (not shown) and selectively controlled, together with other refrigerator features, by a microprocessor (not shown in FIG. 1) according to user preference via manipulation of a control interface 124 mounted in an upper region of fresh food storage compartment 102 and coupled to the microprocessor. A shelf 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown in FIG. 1), a condenser (not shown in FIG. 1), an expansion device (not shown in FIG. 1), and an evaporator (not shown in FIG. 1) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown in FIG. 1). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator and to maintain selected temperatures. Compartment temperatures are set by user manipulation of interface 124 and compartment temperature feedback is displayed to the user according to the control scheme set forth below.

Figure 2:
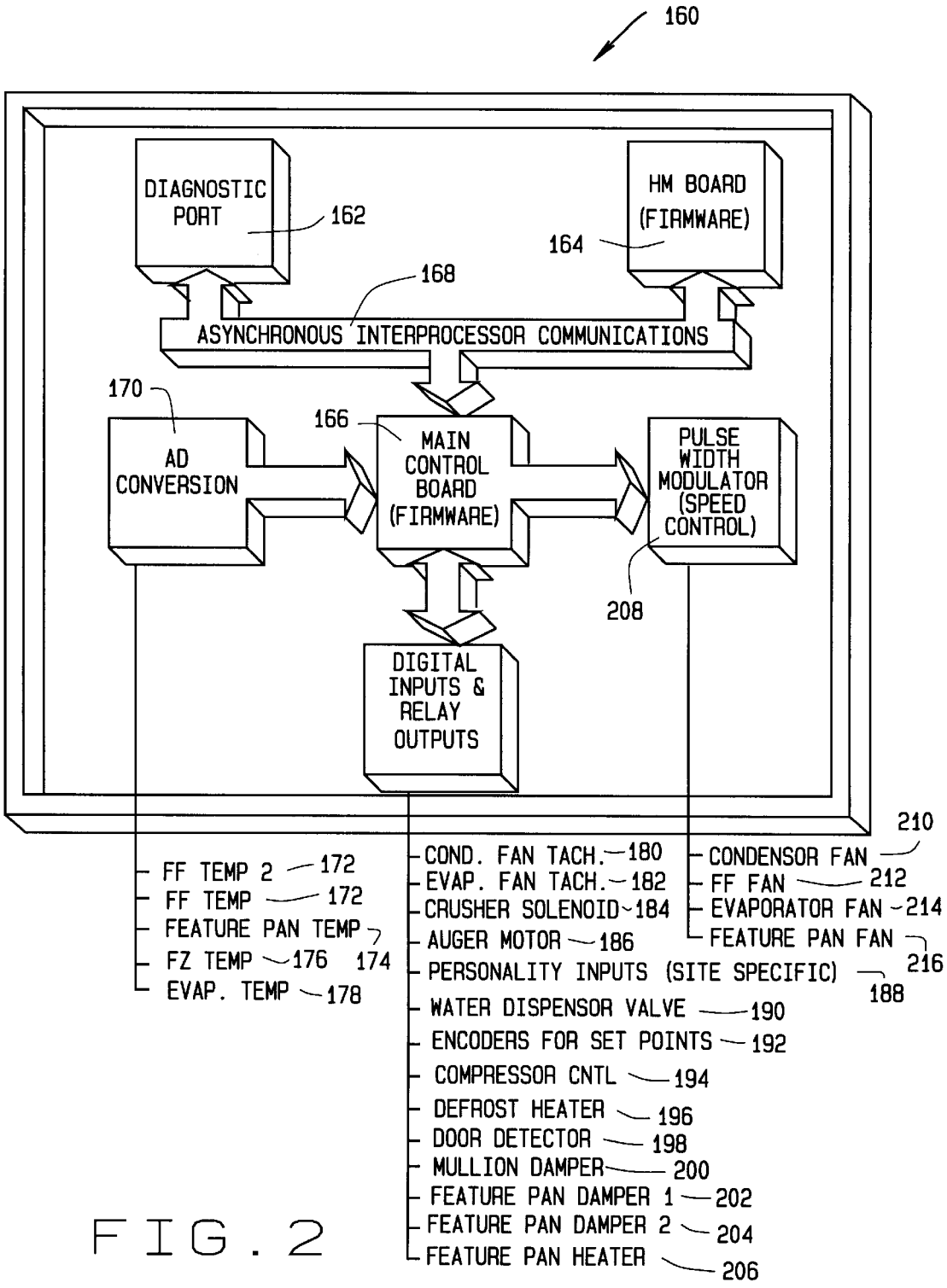
FIG. 2 is a block diagram of a refrigerator controller in accordance with one embodiment of the present invention.
Figure 3A:
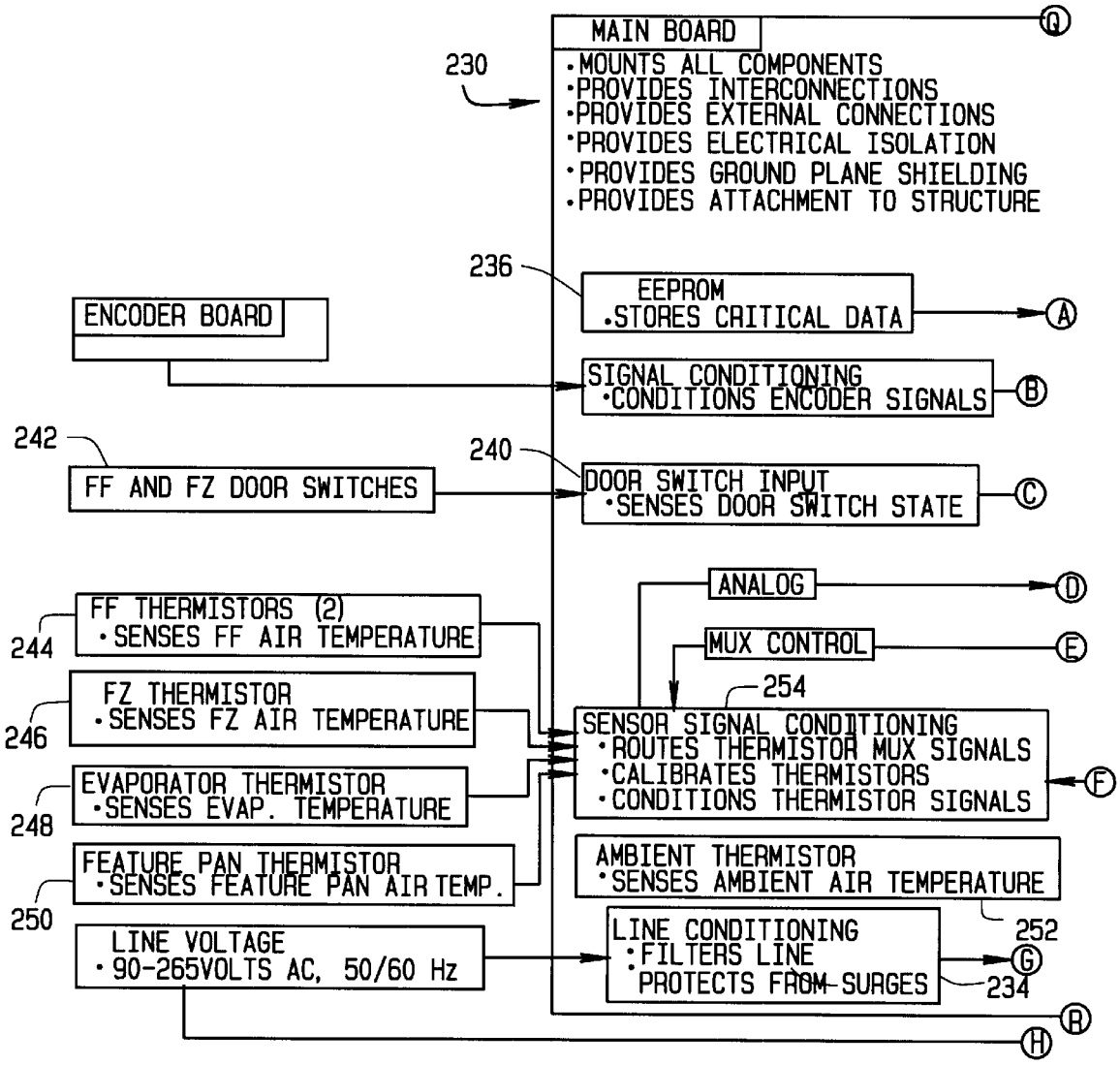
FIGS. 3A, 3B, and 3C are a block diagram of the main control board shown in FIG. 2.
Figure 3B:
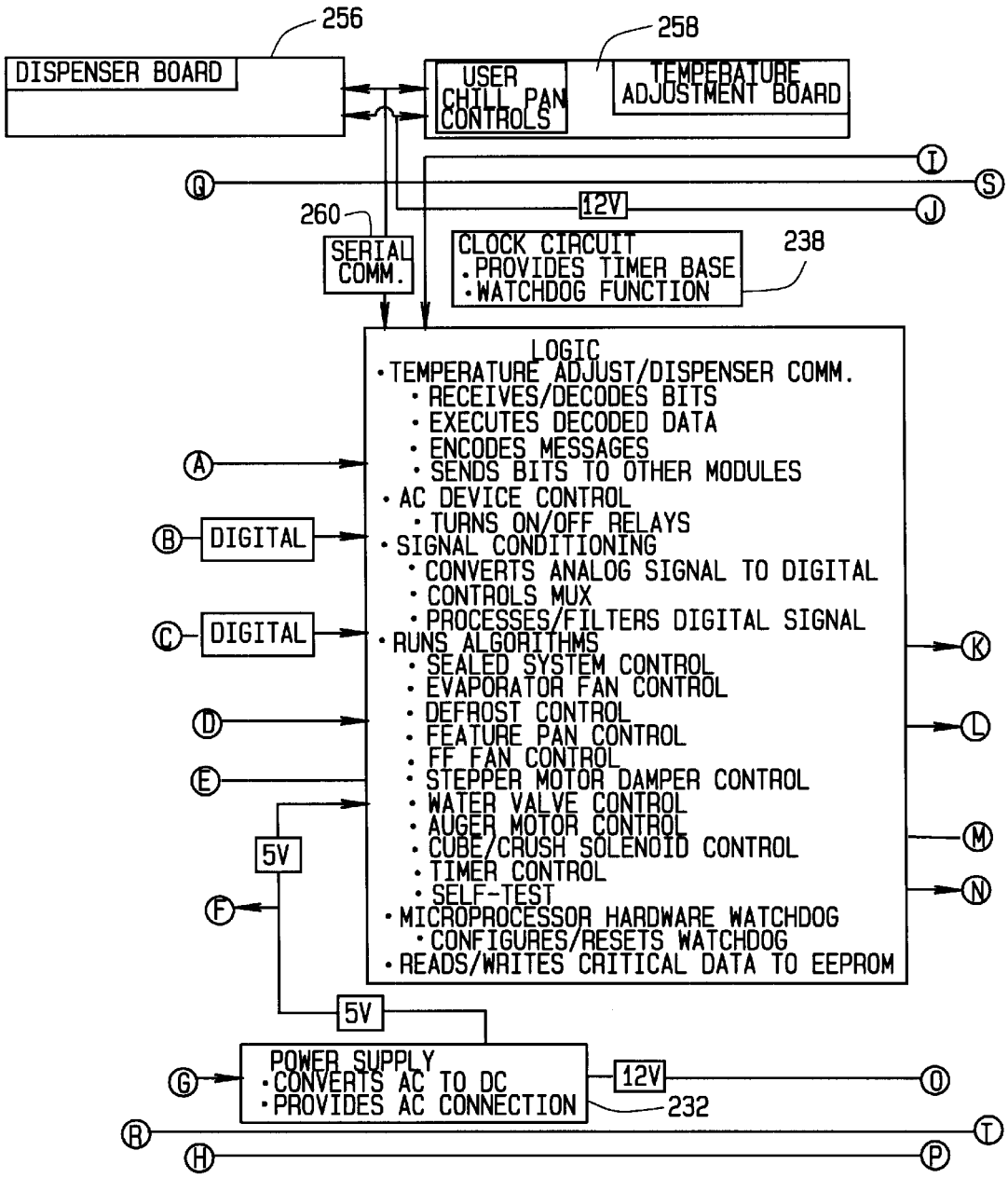
Figure 3C:
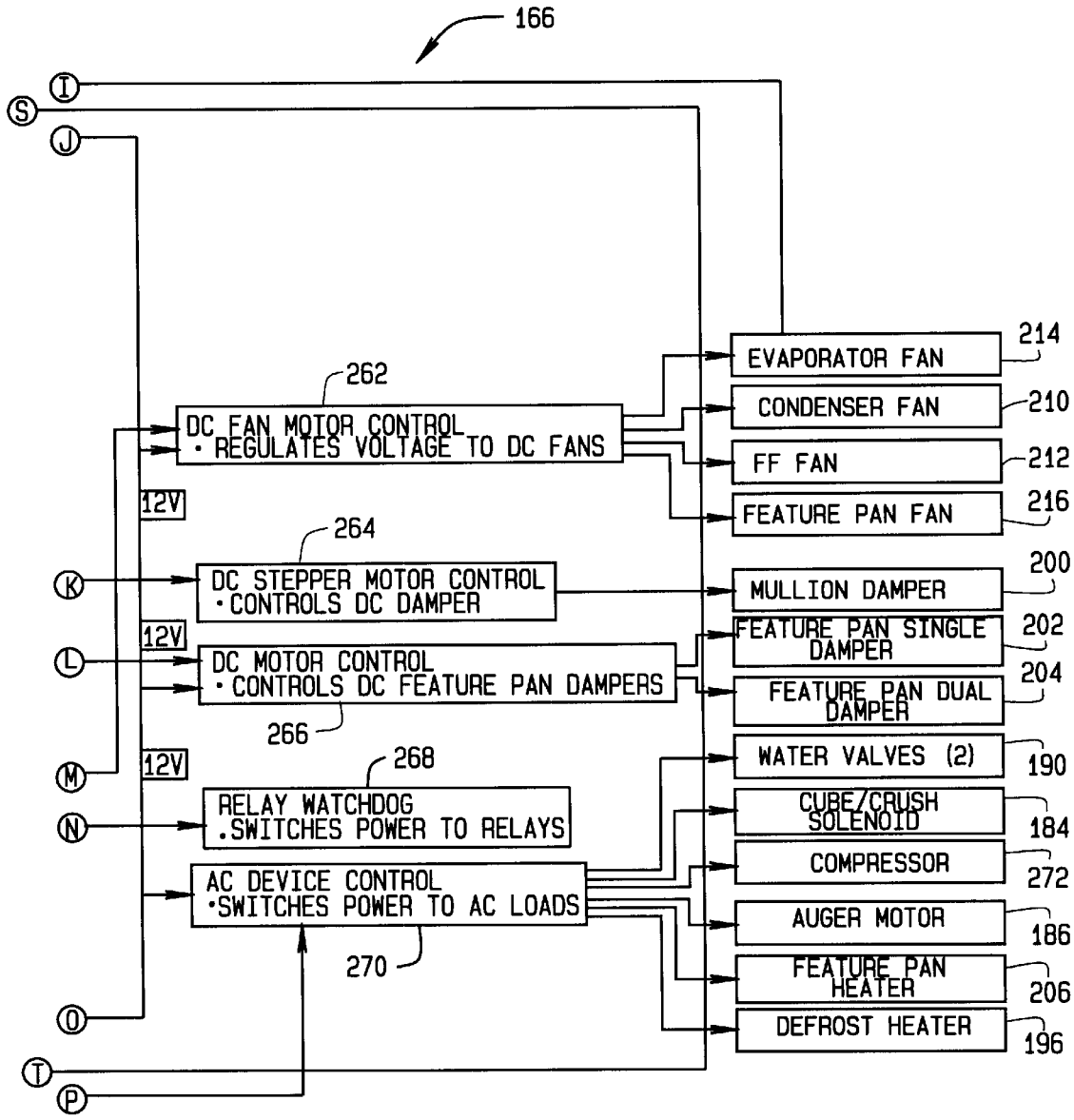
Figure 4:
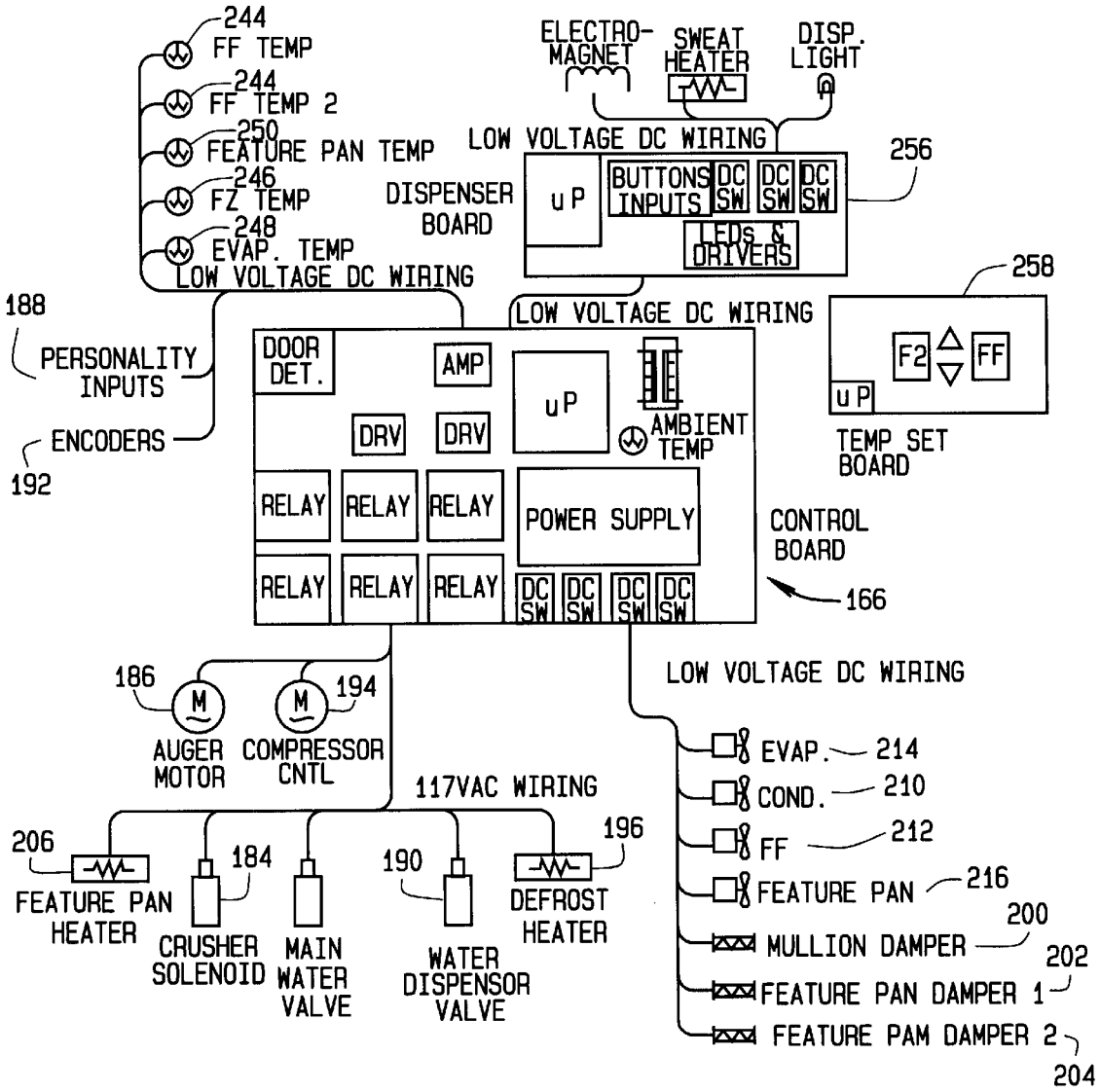
FIG. 4 is a block diagram of the main control board shown in FIG. 2.

FIG. 2 illustrates a controller 160 in accordance with one embodiment of the present invention. Controller 160 can be used, for example, in refrigerators, freezers and combinations thereof, such as, for example side-by-side refrigerator 100 (shown in FIG. 1).

Controller 160 includes a diagnostic port 162 and a human machine interface (HMI) board 164 coupled to a main control board 166 by an asynchronous interprocessor communications bus 168. An analog to digital converter ("A/D converter") 170 is coupled to main control board 166. A/D converter 170 converts analog signals from a plurality of sensors including one or more fresh food compartment temperature sensors 172, a quick chill/thaw feature pan (i.e., pan 122 shown in FIG. 1) temperature sensors 174, freezer temperature sensors 176, external temperature sensors (not shown in FIG. 2), and evaporator temperature sensors 178 into digital signals for processing by main control board 166.

In an alternative embodiment (not shown), A/D converter 170 digitizes other input functions (not shown), such as a power supply current and voltage, brownout detection, compressor cycle adjustment, analog time and delay inputs (both use based and sensor based) where the analog input is coupled to an auxiliary device (e.g., clock or finger pressure activated switch), analog pressure sensing of the compressor sealed system for diagnostics and power/energy optimization. Further input functions include external communication via IR detectors or sound detectors, HMI display dimming based on ambient light, adjustment of the refrigerator to react to food loading and changing the air flow/pressure accordingly to ensure food load cooling or heating as desired, and altitude adjustment to ensure even food load cooling and enhance pull-down rate of various altitudes by changing fan speed and varying air flow.

Digital input and relay outputs correspond to, but are not limited to, a condenser fan speed 180, an evaporator fan speed 182, a crusher solenoid 184, an auger motor 186, personality inputs 188, a water dispenser valve 190, encoders 192 for set points, a compressor control 194, a defrost heater 196, a door detector 198, a mullion damper 200, feature pan air handler dampers 202, 204, and a quick chill/thaw feature pan heater 206. Main control board 166 also is coupled to a pulse width modulator 208 for controlling the operating speed of a condenser fan 210, a fresh food compartment fan 212, an evaporator fan 214, and a quick chill system feature pan fan 216.

FIGS. 3A, 3B, 3C, and 4 are more detailed block diagrams of main control board 166. as shown in FIGS. 3A, 3B, 3C, and 4, main control board 166 includes a processor 230. Processor 230 performs temperature adjustments/dispenser communication, AC device control, signal conditioning, microprocessor hardware watchdog, and EEPROM read/write functions. In addition, processor executes many control algorithms including sealed system control, evaporator fan control, defrost control, feature pan control, fresh food fan control, stepper motor damper control, water valve control, auger motor control, cube/crush solenoid control, timer control, and self-test operations.

Processor 230 is coupled to a power supply 232 which receives an AC power signal from a line conditioning unit 234. Line conditioning unit 234 filters a line voltage which is, for example, a 90–265 Volts AC, 50/60 Hz signal. Processor 230 also is coupled to an EEPROM 236 and a clock circuit 238.

A door switch input sensor 240 is coupled to fresh food and freezer door switches 242, and senses a door switch state. A signal is supplied from door switch input sensor 240 to processor 230, in digital form, indicative of the door switch state. Fresh food thermistors 244, a freezer thermistor 246, at least one evaporator thermistor 248, a feature pan thermistor 250, and an ambient thermistor 252 are coupled to processor 230 via a sensor signal conditioner 254. Conditioner 254 receives a multiplex control signal from processor 230 and provides analog signals to processor 230 representative of the respective sensed temperatures. Processor 230 also is coupled to a dispenser board 256 and a temperature adjustment board 258 via a serial communications link 260. Conditioner 254 also calibrates the above-described thermistors 244, 246, 248, 250, and 252.

Processor 230 provides control outputs to a DC fan motor control 262, a DC stepper motor control 264, a DC motor control 266, and a relay watchdog 268. Watchdog 268 is coupled to an AC device controller 270 that provides power to AC loads, such as to water valve 190, cube/crush solenoid 184, a compressor 272, auger motor 186, a feature pan heater 206, and defrost heater 196. DC fan motor control 266 is coupled to evaporator fan 214, condenser fan 210, fresh food fan 212, and feature pan fan 216. DC stepper motor control 266 is coupled to mullion damper 200, and DC motor control 266 is coupled to one of more sealed system dampers. These functions are performed under the control of firmware implemented as small independent state machines.

Figure 5:
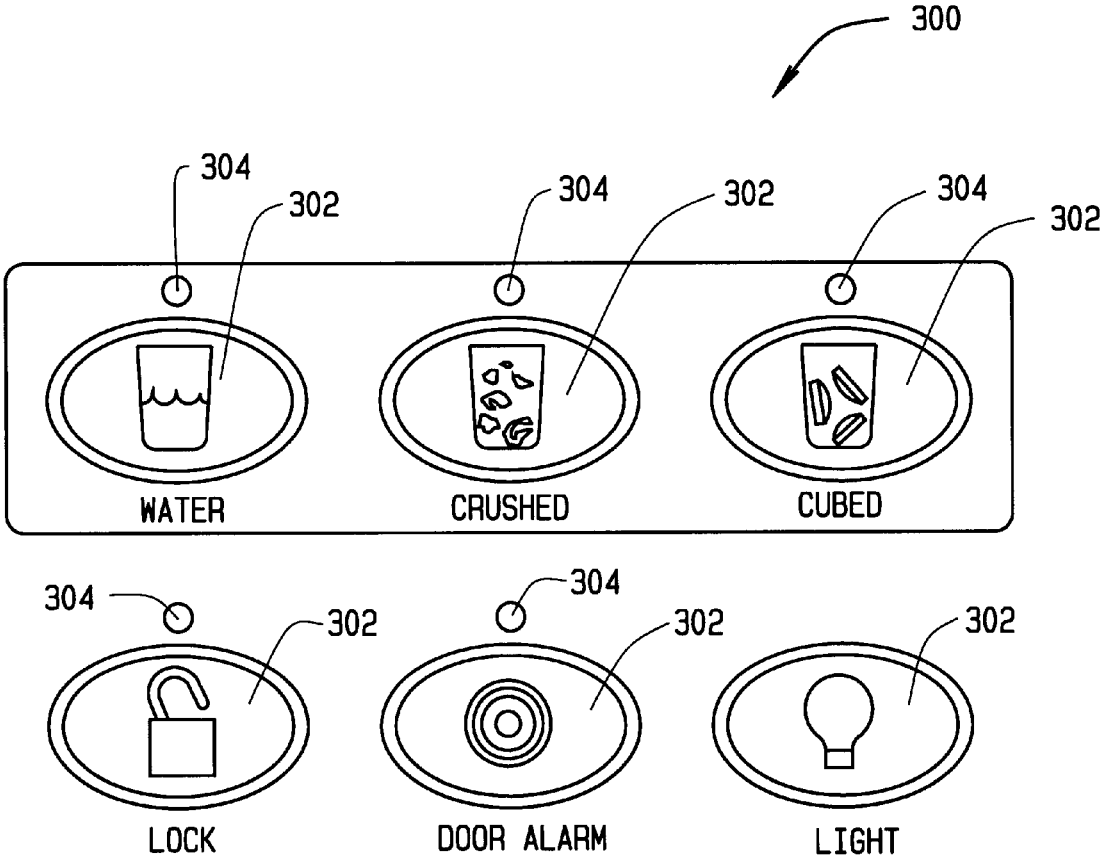
FIG. 5 illustrates an interface for a refrigerator the refrigerator shown in FIG. 1.

Control interface 124 (shown in FIG. 1) is split into one or more human machine interface (HMI) boards including displays. For example, FIG. 5 illustrates an HMI board 300 for a refrigerator including dispensers. Board 300 includes a plurality of touch sensitive keys or buttons 302 for selection of various options, and accompanying LED's 304 to indicate selection of an option.

Figure 6:
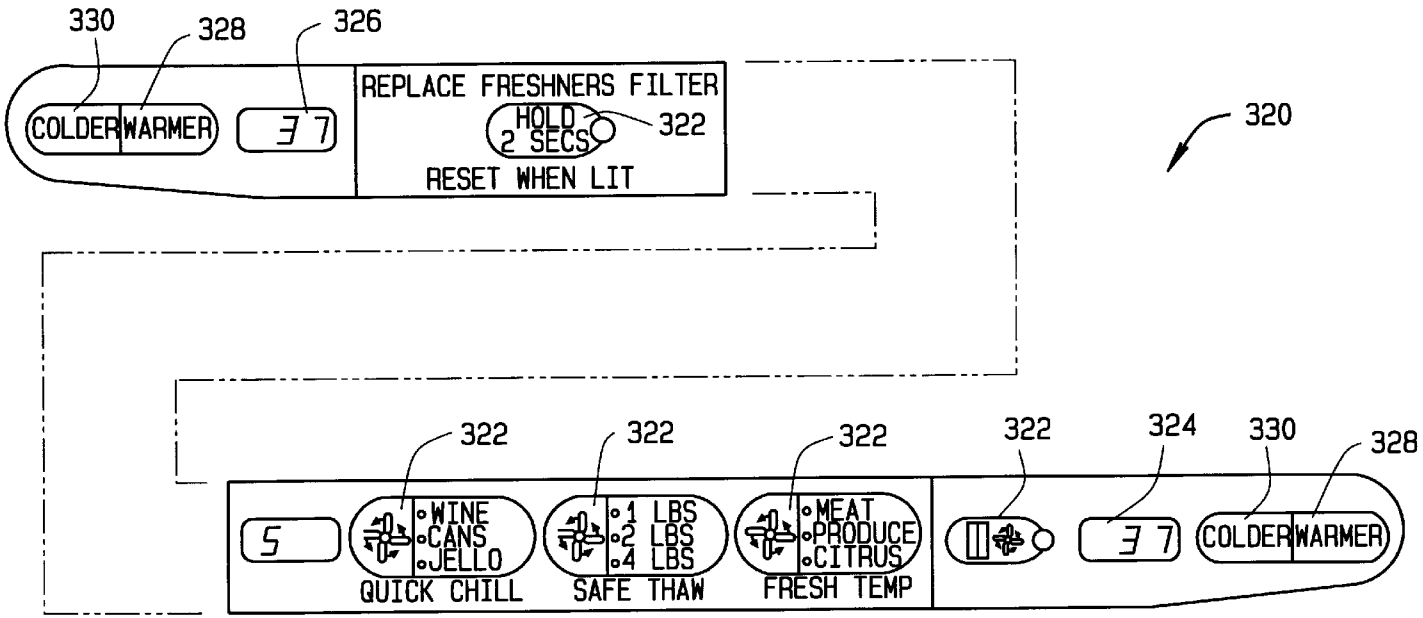
FIG. 6 illustrates a second interface for the refrigerator shown in FIG. 1.

FIG. 6 illustrates an exemplary HMI board 320 for a refrigerator including electronic cold control, such as refrigerator 100 (shown in FIG. 1). Board 320 also includes a plurality of touch sensitive keys or buttons 322 including LEDs to indicate activation of a selected control feature, a fresh food compartment actual temperature display 324, a freezer compartment actual temperature display 326, and respective warmer/up slew keys 328 and colder/down slew keys 330 for adjusting temperature settings of fresh food compartment 102 and freezer compartment 104 (shown in FIG. 1).

Figure 7:
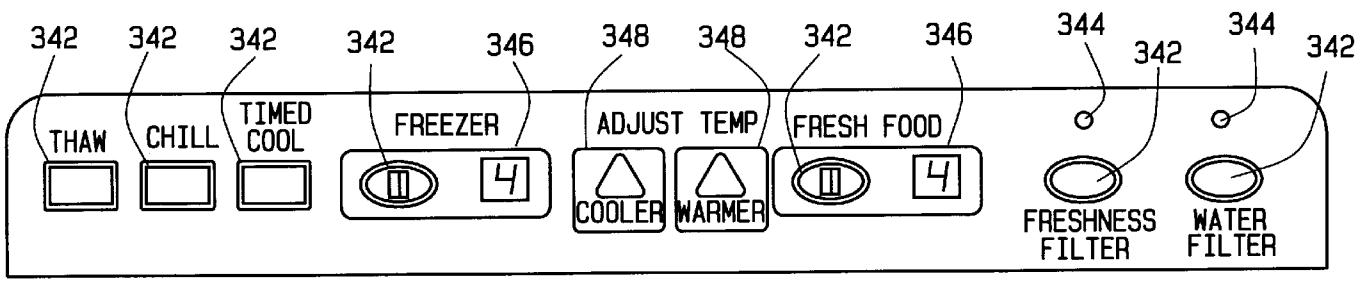
FIG. 7 illustrates a second embodiment of an interface for a refrigerator.

FIG. 7 illustrates yet another embodiment of a cold control HMI board 340 including a plurality of touch sensitive keys or buttons 342 including LEDs 344 to indicate activation of a selected control feature, temperature zone displays 346 for fresh food and freezer compartments, and slew keys 348 for adjusting temperature settings.

The temperature setting system is substantially the same for each HMI user interface 320, 340. When fresh food door 134 (shown in FIG. 1) is closed, the HMI displays are off. When fresh food door 134 is opened, the displays turn on and operate according to the following scheme.

Referring to FIG. 6, the freezer compartment temperature is set in one embodiment as follows. In normal operation the current freezer temperature is displayed. When one of the freezer slew keys 326 is depressed, the LED next to "SET" (located just below slew keys 326 in FIG. 6) is illuminated, and controller 160 (shown in FIGS. 2–4) waits for operator input. Thereafter, for each time the freezer colder/slew-down key 330 is depressed, the display value on freezer temperature display 326 will decrement by one, and for each time the user presses the warmer/slew-up key 328 the display value on freezer temperature display 326 will increment by one. Thus, the user may increase or decrease the freezer set temperature using the freezer slew keys 328 and 330 on board 320.

Once the SET LED is illuminated, if freezer slew keys 328, 330 are not pressed within a few seconds, such as one to ten seconds, the SET LED will turn off and the current freezer set temperature will be maintained. After this period the user will be unable to change the freezer setting unless one of freezer slew keys 328, 330 is again pressed to re-illuminate the SET LED.

If the freezer temperature is set to a predetermined lower temperature outside of a standard operating range of freezer compartment, such as 7° F. in an exemplary embodiment, both fresh food and freezer displays 324, 326 will display an "off" indicator, and controller 160 shuts down the sealed system. The sealed system may be reactivated by pressing the freezer colder/slew-down 330 key so that the freezer temperature display is a predetermined temperature within the standard operating range, such as 6° F. or lower.

In one embodiment, freezer temperature may be set only in a range between −6° F. and 6° F. In alternative embodiments, other setting increments and ranges are contemplated in lieu of the exemplary embodiment described above.

In a further alternative embodiment, such as that shown in FIG. 7, temperature indicators other than actual temperature are displayed, such as a system selectively operable at a plurality of levels, e.g., level "1" through level "9" where one of the extremes, e.g., level "1," is a warmest setting and the other extreme, e.g., level "9," is a coldest setting. The settings are incremented or decremented accordingly between the two extremes on temperature zone or level displays 346 by pressing applicable warmer/slew-up or colder/slew-down keys 348. The freezer temperature is set using board 340 substantially as described above.

Similarly, and referring back to FIG. 6, fresh food compartment temperature is set in one embodiment as follows. In normal operation, the current fresh food temperature is displayed. When one of the fresh food slew keys 328, 330 is depressed, the LED next to "SET" (located just below refrigerator slew keys 328, 330 in FIG. 6) is illuminated and controller 160 waits for operator input. The displayed value on refrigerator temperature display 324 will decrement by one for each time the user presses the colder/slew-down key 330, and the display value on refrigerator temperature display 324 will increment by one for each time the user presses the warmer/slew-up key 328.

Once the SET LED is illuminated, if the fresh food compartment slew keys 328, 330 are not pressed within a predetermined time interval, such as one to ten seconds in an exemplary embodiment, the SET LED will turn off and the current fresh food set temperature will be maintained. After this period the user will be unable to change the fresh food compartment setting unless one of slew keys 328, 330 is again pressed to re-illuminate the SET LED.

If the user attempts to set the fresh food temperature above a normal operating range, such as 46° F., both fresh food and freezer displays 322, 324 will display an "off" indicator, and controller 160 shuts down the sealed system. The sealed system may be reactivated by pressing the colder/slew-down key so that the set fresh food compartment set temperature is within the normal operating range, such as 45° F. or lower.

In one embodiment, fresh food temperature may be set only in a range between 34° F. and 45° F. In alternative embodiments, other setting increments and ranges are contemplated in lieu of the exemplary embodiment described above.

In a further alternative embodiment, such as that shown in FIG. 7, temperature indicators other than actual temperature are displayed, such as a system selectively operable at a plurality of levels, e.g., level "1" through level "9" where one of the extremes, e.g., level "1" is a warmest setting and the other extreme, e.g., level "9," is a coldest setting. The settings are incremented or decremented accordingly between the two extremes on temperature zone or level displays 346 by pressing the applicable warmer/slew-up or colder/slew-down key 348, and the fresh food temperature may be set as described above.

Once fresh food compartment and freezer compartment temperatures are set, actual temperatures (for the embodiment shown in FIG. 6) or temperature levels (for the embodiment shown in FIG. 7) are monitored and displayed to the user. To avoid undue changes in temperature displays during various operational modes of the refrigerator system that may mislead a user to believe that a malfunction has occurred, the behavior of the temperature display is altered in different operational modes of refrigerator 100 to better match refrigerator system behavior with consumer expectations. In one embodiment, for ease of consumer use control boards 320, 340 and temperature displays 324, 326, 246 are configured to emulate the operation of a thermostat.

Normal Operation Display

For temperature settings, and as further described below, a normal operation mode is defined as closed door operation after a first state change cycle, i.e., a change of state from "warm" to "cold" or vice versa , due to a door opening or defrost operation. Under normal operating conditions, HMI board 320 (shown in FIG. 6) displays an actual average temperature of fresh food and freezer of compartments 102, 104, except that HMI board 320 displays the set temperature for fresh food and freezer compartments 102, 104 while actual temperature fresh food is and freezer compartments 102, 104 is within a dead band for the freezer or the fresh food compartments.

Outside the dead band, however, HMI board 320 displays an actual average temperature for fresh food and freezer compartments 102, 104. For example, for a 37° F. fresh food temperature setting and a dead band of +/−2° F., actual and displayed temperature is as follows.

| | | | | | | | | | | | | |
|---|---|---|---|---|---|---|---|---|---|---|---|---|
| Actual Temp. | 34 | 34.5 | 35 | 36 | 37 | 38 | 39 | 39.5 | 40 | 40.5 | 41 | 42 |
| Display Temp. | 35 | 36 | 37 | 37 | 37 | 37 | 37 | 38 | 39 | 40 | 41 | 42 |

Thus, in accordance with user expectations, actual temperature displays 324, 326 are not changed when actual temperature is within the dead band, and the displayed temperature display quickly approaches the actual temperature when actual temperatures are outside the dead band. Freezer settings are also displayed similarly within and outside a predetermined dead band. The temperature display is also damped, for example, by a 30 second time constant if the actual temperature is above the set temperature and, for example, by a 20 second time constant if the actual temperature is below the set temperature.

Door Open Display

A door open operation mode is defined as time while a door is open and while the door is closed after a door open event until the sealed system has cycled once (changed state from warm-to-cold, or cold-to-warm once), excluding a door open operation during a defrost event. During door open events, food temperature is slowly and exponentially increasing. After door open events, temperature sensors in the refrigerator compartments determine the overall operation and this is to be matched by the display.

Fresh Food Display

During door open operation, temperature display for the fresh food compartment is modified as follows depending on actual compartment temperature, the set temperature, and whether actual temperature is rising or falling.

When actual fresh food compartment temperature is above the set temperature and is rising, the fresh food temperature display damping constant is activated and dependent upon a difference between the actual and set temperature. In an exemplary embodiment, the damping constant is five minutes for a set temperature versus actual temperature difference of, for example, 2° F. to 4° F., ten minutes for a set temperature versus actual temperature difference of, for example, 4° F. to 7° F., and is, for example, twenty minutes for a set temperature versus actual temperature difference of, for example, greater than 7° F.

When actual fresh food compartment temperature is above the set temperature and falling, the fresh food temperature display damping delay constant is, for example, three minutes.

When actual fresh food compartment temperature is below the set temperature and rising, the fresh food temperature display damping delay constant is, for example, three minutes.

When actual fresh food compartment temperature is below the set temperature and falling, the damping delay constant is, for example, five minutes for a set temperature versus actual temperature difference of, for example, 2° F. to 4° F., ten minutes for a set temperature versus actual temperature difference of, for example, 4° F. to 7° F., and is, for example, 20 minutes for a set temperature versus actual temperature difference of, for example, greater than 7° F.

In alternative embodiments, other settings and ranges are contemplated in lieu of the exemplary embodiment described above.

Freezer Display

During door open operation, the temperature display for the freezer compartment is modified as follows depending on actual freezer compartment temperature, the set freezer temperature, and whether actual temperature is rising or falling.

When actual freezer compartment temperature is above the set temperature and rising, the damping delay constant is, for example, five minutes for a set temperature versus actual temperature difference of, for example, 2° F. to 8° F., ten minutes for a set temperature versus actual temperature difference of, for example, 8° F. to 15° F., and is, for example, twenty minutes for a set temperature versus actual temperature difference of greater than 15° F.

When actual freezer compartment temperature is above the set temperature and falling, the damping delay constant is, for example, three minutes.

When actual freezer compartment temperature is below the set temperature and increasing, the damping delay constant is, for example, three minutes.

When actual freezer compartment temperature is below the set temperature and falling, the damping delay constant is, for example, five minutes for a set temperature versus actual temperature difference of, for example, 2° F. to 8° F., ten minutes for a set temperature versus actual temperature difference of, for example, 8° F. to 15° F., and is, for example, twenty minutes for a set temperature versus actual temperature difference of, for example, greater than 15° F.

In alternative embodiments, other settings and ranges are contemplated in lieu of the exemplary embodiment described above.

Defrost Mode Display

A defrost operation mode is defined as a pre-chill interval, a defrost heating interval and a first cycle interval. During a defrost operation, freezer temperature display 326 shows the freezer set temperature plus, for example, 1° F. while the sealed system is on and shows the set temperature while the sealed system is off, and fresh food display 324 shows the set temperature. Thus, defrost operations will not be apparent to the user.

Defrost Mode, Door Open Display

A mode of defrost operation while a door 132, 134 (shown in FIG. 1) is open is defined as an elapsed time a door is open while in the defrost operation. Freezer display 326 shows the set temperature when the actual freezer temperature is below the set temperature, and otherwise it displays a damped actual temperature with a delay constant of twenty minutes. Fresh food display 324 shows the set temperature when the fresh food temperature is below the set temperature, and otherwise it displays a damped actual temperature with a delay constant of ten minutes.

User Temperature Change Display

A user change temperature mode is defined as a time from which the user changes a set temperature for either the fresh food or freezer compartment until a first seated system cycle is completed. If the actual temperature is within a dead band and the new user set temperature also is within the dead band, one or more sealed system fans are turned on for a minimum amount of time when the user has lowered the set temperature so that the sealed system appears to respond to the new user setting as a user might expect.

If the actual temperature is within the dead band and the new user set temperature is within the dead band, no load is activated if the set temperature is increased. If the actual temperature is within the dead band and the new user set temperature is outside the dead band, then action is taken as in normal operation.

Figure 8:
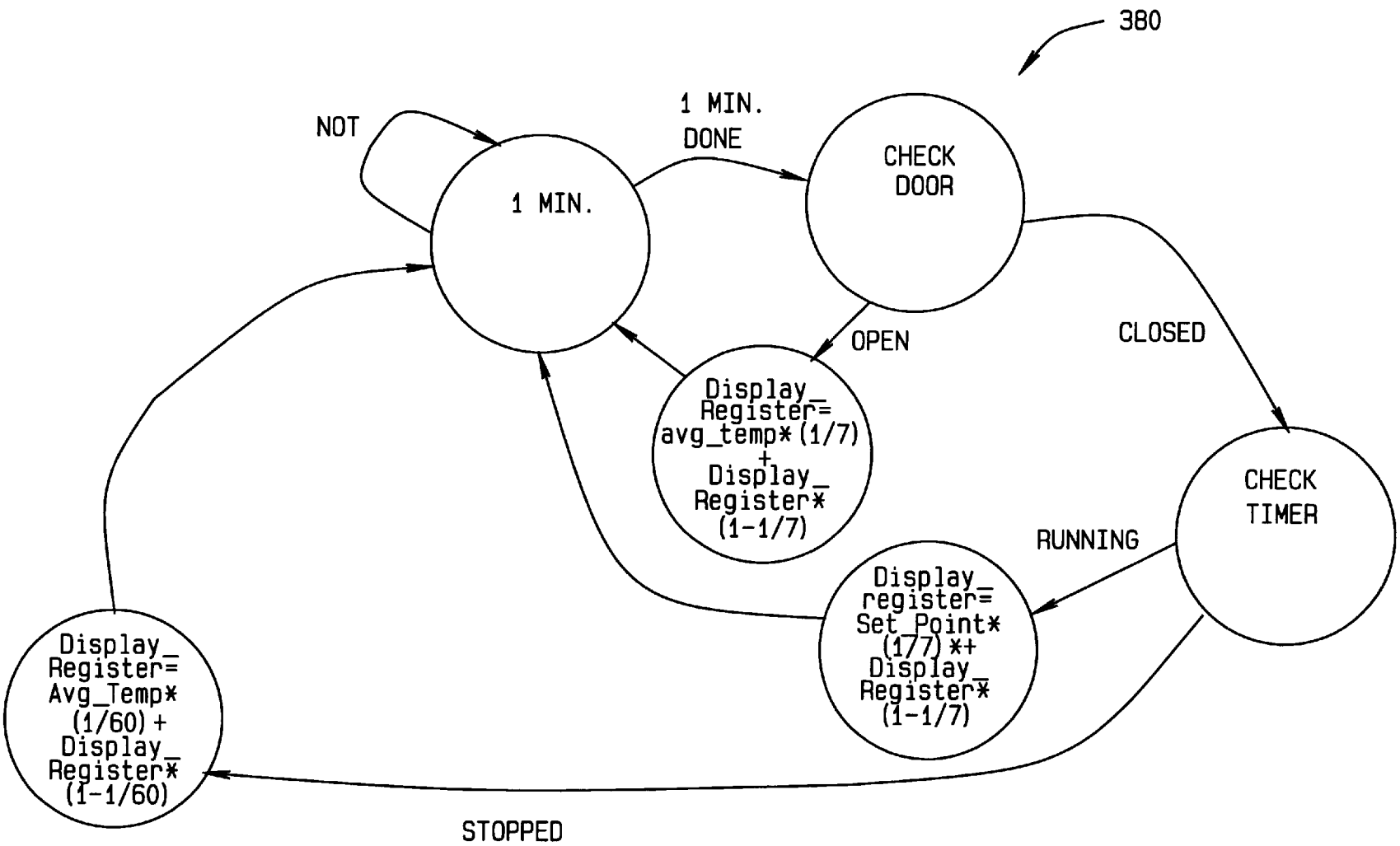
FIG. 8 is a state diagram for fresh food temperature display.
Figure 9:
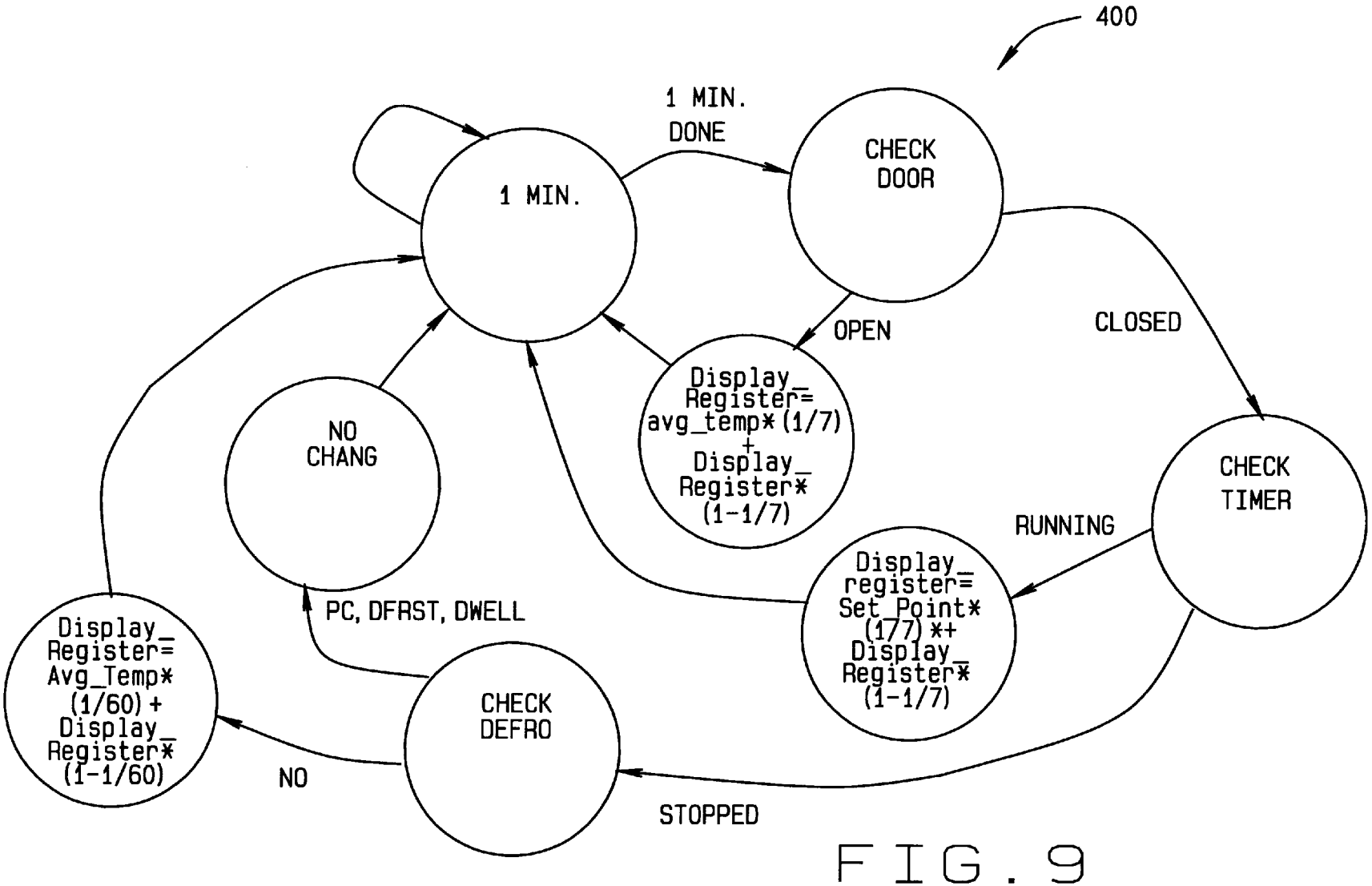
FIG. 9 is a state diagram for freezer temperature display.

Referring now specifically to FIGS. 8 and 9, FIG. 8 is a state diagram 380 for an alternative embodiment of a fresh food temperature display scheme, and FIG. 9 is a state diagram 400 of an alternative embodiment of a freezer temperature display scheme. It may be seen from FIGS. 8 and 9 that several time constants are expressed as fractional values (assuming time is in hour increments) to calculate weighted averages or damped temperature values to display based on set points, average compartment temperatures and the most current display register value (stored in a display register in controller 160 (shown in FIGS. 2–4)). These time constants are considered, in an exemplary embodiment, as variables that may be changed to provide different response times for different refrigeration appliances. Alternatively, the time constants are set to the same value for different refrigerators. A one minute tick (shown in FIGS. 8 and 9) can also be adjusted in the event that a quicker response time is required for a particular system.

An algorithm embodied in state diagrams 698, 700 can be expressed by the rules below for different refrigerator modes and door open events.

One Minute Tick

Request Filtered Avg_FF_Temp /*FF is fresh food*/

Request Filtered FZ_Temp /*FZ is freezer*/

Request Last SS On Time /*SS is sealed system*/

$$SS_Buf = SSOnTime*1/(60*24) + SS_Buf*(1-(1/(60*24)))$$

/*SS_Buf is a rolling average of the SS on time over the last 24 hours*/

Request Prechill, Dwell and Defrost State

On Fresh Food Door Open To Close

Setup and Start FF_Timer for Duration of SS_Buf

/*Set up a decay time for the display to drop back toward the set point*/

On Freezer Door Open To Close

Setup and Start FZ_Timer for Duration of SS_Buf

/*Set up a decay time for the display to drop back toward the set point*/

If (*FF*Door=Open) Display_Register_*FF*=Avg_*FF*_Temp*(1/7)+Display_Register_*FF**(1−1/7)

/*Display_Register receives damped value*/

Else if (*FF*_Timer=Running) Display_Register_*FF*=*FF*_Set_Point*(1/7)+Display_Register_*FF**(1−7)

Else Display_Register_*FF*=Avg_*FF*_Temp*(1/60)+Display_Register_*FF**(1−1/60))

If (*FZ*Door=Open) Display_Register*FZ*=*FZ*_Temp*(1/7)+Display_Register_*FZ**(1−1/7)

Else if (*FZ*_Timer=Running) Display_Register_*FZ*=*FZ*_Set_Point*(1/7)+Display_Register_*FZ**(1−1/7)

Else if (Prechill or Defrost or Dwell) Display_Register_*FZ*=*Display*_Register_*FZ*

Else Display_Register_*FZ*=Avg_*FZ*_Temp*(1/60)+Display_Register_*FZ**(1−1/60)

High Temperature Display

If the averaged temperature of both the fresh food and freezer compartment temperatures is above a predetermined temperature that is outside of a normal operating range of refrigerator 100 (shown in FIG. 1), such as 50° F. in an exemplary embodiment, then the display of both the fresh food and freezer compartment actual temperature is synchronized to the fresh food compartment actual temperature. In an alternative embodiment, the display of both the fresh food and freezer compartment actual temperature is synchronized to the freezer compartment actual temperature.

While the invention has been described in terms of various specific embodiments, those skilled in the art will recognize that the invention can be practiced with modification within the spirit and scope of the claims.

What is claimed is:

1. A method for displaying refrigerator compartment temperatures, the refrigerator including at least one refrigeration compartment, at least one temperature sensor in flow communication with the refrigeration compartment, a display and a controller, said method comprising the steps of:

accepting a set temperature of the at least one compartment;

monitoring actual temperature of the compartment; and displaying a damped temperature value determined by a damping constant, said damping constant dependant upon operating conditions of the refrigerator.

2. A method in accordance with claim 1 wherein said step of displaying a damped temperature value comprises the step of damping the temperature value for a fixed time constant.

3. A method in accordance with claim 2 further comprising the step of selecting one of a plurality of fixed time constants corresponding to a plurality of operating conditions of the refrigerator.

4. A method in accordance with claim 1 wherein said step of displaying a damped temperature values further comprises the step of calculating a damped temperature value based upon a rolling average of actual temperature and the set temperature.

5. A method in accordance with claim 1, the controller including a display register for storing a current displayed value, said step of displaying a damped temperature further comprising the step of calculating a damped actual temperature value based upon a rolling average of actual temperature and the display register value.

6. A method in accordance with claim 1 wherein said step of displaying a damped temperature value comprises the step of displaying a temperature level.

7. A method in accordance with claim 1 wherein the refrigerator includes a freezer compartment, said step of accepting a set temperature comprising the step of accepting a set temperature of −6° F. to 6° F. for the freezer compartment.

8. A method in accordance with claim 1 wherein the refrigerator includes a fresh food compartment, said step of accepting a set temperature comprising the step of accepting a set temperature of 34° F. to 45° F. for the fresh food compartment.

9. A method in accordance with claim 1 wherein said step of displaying a temperature value comprises the step of displaying an actual temperature of the compartment.

10. A method in accordance with claim 9 further comprising the step of displaying the set temperature when the actual temperature is within a range determined by the set temperature plus or minus a dead band.

11. A system for displaying a temperature of a refrigerator compartment, the refrigerator compartment including at least one temperature sensor, said system comprising:

a controller comprising a processor and a memory, said controller operatively coupled to the temperature sensor, and a human machine interface board coupled to the controller and comprising a display, said human machine interface board configured for receiving user input of a refrigerator compartment setting, said controller configured to:

accept a set temperature of the at least one compartment;

monitor actual temperature of the compartment; and display a damp, temperature value according to a damping constant selected in response to operating conditions of the refrigerator.

12. A system in accordance with claim 11, said controller further configured to damp the temperature value for a fixed time constant.

13. A system in accordance with claim 12 said controller further configured to determine the fixed time constant by selecting one of a plurality of fixed time constants corresponding to different operating modes of the refrigerator.

14. A system in accordance with claim 11 said controller configured to calculate a damped temperature value based upon a rolling average of actual temperature and the set temperature.

15. A system in accordance with claim 11, said controller further comprising a display register for storing a current displayed value, said controller configured to calculate a damped actual temperature value based upon a rolling average of actual temperature and the display register value.

16. A system in accordance with claim 11 wherein said controller is configured to display a temperature level.

17. A system in accordance with claim 11 wherein the refrigerator includes a freezer compartment, said controller configured to accept a set temperature of −6° F. to 6° F. for the freezer compartment.

18. A system in accordance with claim 11 wherein the refrigerator includes a fresh food compartment, said controller configured to accept a set temperature of 34° F. to 45° F. for the fresh food compartment.

19. A system in accordance with claim 11, said controller configured to display an actual temperature of the compartment.

20. A system in accordance with claim 19, said controller further configured to display the set temperature when the actual temperature is within a range determined by the set temperature plus or minus a dead band.

21. A system for displaying a temperature of a refrigerator compartment, the refrigerator compartment including at least one temperature sensor, said system comprising:

a human machine interface board comprising a display and a plurality of input keys;

a controller comprising a processor and a memory, said controller operatively coupled to the temperature sensor and to said human machine interface board, said controller configured to emulate the behavior of a thermostat in response to user manipulation of said input keys.

* * * * *

UNITED STATES PATENT AND TRADEMARK OFFICE

CERTIFICATE OF CORRECTION

PATENT NO. : 6,564,561 B2 
DATED : May 20, 2003
INVENTOR(S) : Wolfgang Daum et al.

It is certified that error appears in the above-identified patent and that said Letters Patent is hereby corrected as shown below:

Column 11,
Line 6, delete "a damped temperature values" and insert therefor -- a damped temperature value --.

Column 12,
Line 1, delete "damp, temperature" and insert therefor -- damped temperature --.

Signed and Sealed this

Ninth Day of September, 2003

JAMES E. ROGAN
*Director of the United States Patent and Trademark Office*